US008557755B2

(12) United States Patent
Barton et al.

(10) Patent No.: US 8,557,755 B2
(45) Date of Patent: Oct. 15, 2013

(54) LUBRICATING COMPOSITION CONTAINING AN ANTIWEAR AGENT

(71) Applicant: The Lubrizol Corporation, Wickliffe, OH (US)

(72) Inventors: William R. S. Barton, Belper (GB); Seth L. Crawley, Mentor, OH (US); Patrick E. Mosier, Bay Village, OH (US); Matthew D. Gieselman, Wickliffe, OH (US); Daniel J. Saccomando, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 13/767,021

(22) Filed: Feb. 14, 2013

(65) Prior Publication Data

US 2013/0157914 A1 Jun. 20, 2013

Related U.S. Application Data

(63) Continuation of application No. 13/390,992, filed as application No. PCT/US2010/045576 on Aug. 16, 2010, now Pat. No. 8,404,625.

(60) Provisional application No. 61/234,717, filed on Aug. 18, 2009.

(51) Int. Cl.
*C07C 51/02* (2006.01)
*C10M 129/40* (2006.01)
*C10M 129/32* (2006.01)

(52) U.S. Cl.
USPC ..... 508/517; 508/371; 508/391; 508/460; 508/574

(58) Field of Classification Search
USPC ..... 508/370, 465, 391, 460, 517
See application file for complete search history.

(56) References Cited

U.S. PATENT DOCUMENTS

| | | | |
|---|---|---|---|
| 4,151,102 | A | 4/1979 | Baur et al. |
| 4,157,970 | A | 6/1979 | Yaffe |
| 4,237,022 | A | 12/1980 | Barrer |
| 4,436,640 | A | 3/1984 | Yamaguchi |
| 4,512,903 | A | 4/1985 | Schlicht et al. |
| 4,863,622 | A | 9/1989 | Chiu |
| 5,132,034 | A | 7/1992 | Hsu |
| 5,215,549 | A | 6/1993 | Hsu |
| 5,338,470 | A | 8/1994 | Hiebert |
| 6,127,327 | A | 10/2000 | Camenzind |
| 7,696,136 | B2 | 4/2010 | Migdal et al. |
| 2009/0305919 | A1 | 12/2009 | Tipton et al. |

FOREIGN PATENT DOCUMENTS

| | | | |
|---|---|---|---|
| CA | 1183125 | | 2/1985 |
| DE | DD299533 | A5 | 4/1992 |
| DE | 102007004292 | A1 | 7/2008 |
| WO | 9864705 | A1 | 10/1998 |
| WO | 2005087904 | | 9/2005 |
| WO | 2006044411 | | 4/2006 |
| WO | 2007044820 | A1 | 4/2007 |
| WO | 2008014319 | A2 | 1/2008 |
| WO | 2008070307 | | 6/2008 |

OTHER PUBLICATIONS

Corresponding PCT Publication No. WO 2011/022317 A1 & Search Report published Feb. 24, 2011.
Written Opinion from corresponding International Application No. PCT/US2010/044576 dated Sep. 24, 2010.
JP 2005139238A, Idemitsu Kosan, Jun. 2, 2005—available as Abstract 2005:474631 HCAPLUS.
JP 10183161A, Kyodo Oil and Fats Co., Jul. 14, 1998—available as Abstract 1998:455134 HCAPLUS.
JP 10130679A, Kyodo Oil and Fats Co., May 19, 1998—available as Abstract 1998:314367 HCAPLUS.
JP 05117680A, Tonen Corp., May 14, 1993—available as Abstract 1993:542791 HCAPLUS.
German DD 299533 A5, Hydrierwerk Zietz, Apr. 23, 1992; available as Abstract 1992:637040 HCAPLUS.

*Primary Examiner* — Ellen McAvoy
*Assistant Examiner* — Vishal Vasisth
(74) *Attorney, Agent, or Firm* — Michael F. Esposito, Esq.; David M. Shold, Esq.

(57) ABSTRACT

The invention provides a lubricating composition containing an oil of lubricating viscosity and a compound obtained/obtainable by a process comprising reacting a glycolic acid, a 2-halo-acetic acid, or a lactic acid, or an alkali or alkaline metal salts thereof, (typically glycolic acid or a 2-halo-acetic acid) with at least one member selected from the group consisting of an amine, an alcohol, and an aminoalcohol. The invention further relates to the use of the lubricating composition in an internal combustion engine.

16 Claims, No Drawings

LUBRICATING COMPOSITION CONTAINING AN ANTIWEAR AGENT

This application is a CON of Ser. No. 13/390,992, filed Apr. 27, 2012, now U.S. Pat. No. 8,404,625 which is a 371 of PCT/US2010/045576, filed Aug. 16, 2010 which claims benefit of 61/234,717 filed Aug. 18, 2009.

FIELD OF INVENTION

The invention provides a lubricating composition containing an antiwear agent and an oil of lubricating viscosity. The invention further relates to the use of the lubricating composition in an internal combustion engine.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on engine component wear (in both iron and aluminium based components), bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact of ZDDP on copper corrosion. Other additives may also increase lead corrosion.

Further, engine lubricants containing phosphorus compounds and sulphur have been shown to contribute in part to particulate emissions and emissions of other pollutants. In addition, sulphur and phosphorus tend to poison the catalysts used in catalytic converters, resulting in a reduction in performance of said catalysts.

With increasing control of both the formation of sulphated ash and release of emissions (typically to reduce NOx formation, SOx formation) there is a desire towards reduced amounts of sulphur, phosphorus and sulphated ash in engine oils. Consequently, the amounts of phosphorus-containing antiwear agents such as ZDDP, overbased detergents such as calcium or magnesium sulphonates and phenates have been reduced. As a consequence, ashless additives such as esters of polyhydric alcohols or hydroxyl containing acids including glycerol monooleate and alkoxylated amines have been contemplated to provide friction performance. However there have been observations that ashless friction modifiers may in some instances increase corrosion of metal, namely, copper or lead. Copper and lead corrosion may be from bearings and other metal engine components derived from alloys using copper or lead. Consequently, there is a need to reduce the amount of corrosion caused by ashless additives. However, reducing the levels of antiwear and other ash-containing additives may result in increasing amounts of wear and/or copper corrosion.

Canadian Patent CA 1 183 125 (by Barrer, filed Sep. 10, 1981) discloses lubricants for gasoline engines containing alkyl-ester tartrates, where the sum of carbon atoms on the alkyl groups is at least 8. The tartrates are disclosed as antiwear agents. Other references disclosing tartrates and/or tartrimides include International Publication WO 2006/044411, and US Patent Applications for internal combustion engines requiring reduced amounts of sulphur, sulphated ash, and phosphorus. The lubricant composition has anti-wear or anti-fatigue properties. The lubricating compositions are suitable for road vehicles.

U.S. Pat. No. 4,237,022 (by Barrer, filed Dec. 2, 1980) discloses tartrimides useful as additives in lubricants and fuels for effective reduction in squeal and friction as well as improvement in fuel economy.

U.S. Pat. No. 5,338,470 (by Hiebert, filed Dec. 10, 1992) and International Publication WO 2005/087904 (by Migdal, filed Mar. 11, 2004) disclose lubricants containing at least one hydroxycarboxylic acid ester or hydroxy polycarboxylic acid (in particular citrates or ethyl glycolate). The lubricant composition has anti-wear or anti-fatigue properties.

International Application WO2008/070307 (by Brown, filed Oct. 22, 2007) discloses engine lubricants containing antiwear agents based on malonate esters.

U.S. Pat. No. 4,436,640 (by Yamaguchi and filed on May 27, 1982) discloses a lubricant antiwear agent prepared by a two step reaction involving (i) reacting glycolic acid with an alcohol containing 1 to 6 carbon atoms, and (ii) reacting the product of (i) with phosphorus pentasulphide. The antiwear agent is reported to be useful for a cam-follower set.

Lubricants additives derived from thioglycolic acid derivatives have been contemplated as additives. Additives from thioglycolic acid derivatives are summarised in a variety of U.S. Patents, Japanese patent application and an East German Patent. The U.S. Patents include U.S. Pat. No. 4,157,970 (by Yaffe and filed on Jun. 12, 1979), U.S. Pat. No. 4,863,622 (by Chiu, filed Sep. 5, 1989), U.S. Pat. No. 5,132,034 (by Hsu, filed on Jul. 21, 1992 and June 1), U.S. Pat. No. 5,215,549 (by Hsu, filed on Jun. 1, 1993), and U.S. Pat. No. 6,127,327 (by Camenzind and filed on Jun. 24, 1999). The Japanese Patent Applications include 2005139238 A (by Yanagi and filed on Jun. 2, 2005), Japanese Patent Applications 10183161A (by Imai and filed on Jul. 14, 1998) and 10130679A (by Endo and filed on May 19, 1998), 05117680A (by Sato and filed on May 15, 1993). The East German Patent is DD 299533 A5 (by Buechner, published Apr. 23, 1992).

SUMMARY OF THE INVENTION

The inventors of this invention have discovered a lubricating composition that is capable of providing at least one of antiwear performance, friction modification (particularly for enhancing fuel economy), or lead or copper (typically lead) corrosion inhibition.

As used herein reference to the amounts of additives present in the lubricating composition disclosed herein are quoted on an oil free basis i.e., amount of actives.

In one embodiment the present invention provides a lubricating composition comprising an oil of lubricating viscosity and a compound obtained/obtainable by a process comprising reacting a glycolic acid, a 2-halo-acetic acid, or a lactic acid, or an alkali or alkaline metal salts thereof, (typically glycolic acid or a 2-halo-acetic acid) with at least one member selected from the group consisting of an amine, an alcohol, and an aminoalcohol.

The alcohol may be selected from the group consisting of an alkoxy alcohol, a phenoxy alcohol, a mono alcohol, a diol (may be a 1,2-diol, or a 1,3-diol, or a 1,4-diol, typically 1,2-diol), a triol and a higher polyol (such as a tetraol or pentaol, typically tetraol). The amine may be selected from the group consisting of a monoamine, a polyamine (such as a diamine, a triamine, or higher polyamine).

In one embodiment the compound is obtained/obtainable by the process described herein may be prepared by reacting on a mole ratio basis 0.9 moles to 6 moles of either the glycolic acid or lactic acid with one mole of alcohol or amine. In one embodiment the compound is obtained/obtainable by the process described herein may be prepared by reacting on a mole ratio basis 1.2 moles to 6 moles of either the glycolic acid or lactic acid with one mole of alcohol or amine. In one embodiment the compound is obtained/obtainable by the process described herein may be prepared by reacting on a mole ratio basis 1.5 moles to 4 moles of either the glycolic acid or lactic acid with one mole of alcohol or amine. Typically when the alcohol is a mono-alcohol of general formula $R^1$—OH (wherein $R^1$ may independently be a hydrocarbyl group, typically containing 4 to 30, or 6 to 20, or 8 to 18 carbon atoms) the mole ratio of either glycolic acid or lactic acid to mono alcohol may be in the range of 1.2 to 6 to one mole of alcohol, or even 1.5 to 4 to one mole of alcohol.

The compound is obtained/obtainable by the process described herein may be present at 0.01 to 5 wt %, or 0.1 wt % to 3 wt %, or 0.2 wt % to 1.5 wt %, or 0.25 wt % to 1 wt % of the lubricating composition. In one embodiment the compound may be present at 0.1 wt % to 1 wt % of the lubricating composition.

When the compound obtained/obtainable by the process described herein is a hydrocarbyl-substituted glycolate (typically an alkyl glycolate or alkoxy glycolate), it may be present at 0.5 to 1.5 wt % or 0.5 wt % to 1 wt % of the lubricating composition.

In one embodiment the invention provides a method of lubricating an internal combustion engine comprising supplying to the internal combustion engine a lubricating composition as disclosed herein.

In one embodiment the invention provides a method of lubricating an internal combustion engine as disclosed herein, wherein the internal combustion engine has surfaces of an aluminium alloy, or aluminium composite. Typically, the lubricating composition for lubricating a surface of aluminium alloy or aluminium composite may be a lubricating composition comprising an oil of lubricating viscosity and a compound obtained/obtainable by a process comprising reacting a glycolic acid, a 2-halo-acetic acid, or a lactic acid, or an alkali or alkaline metal salts thereof, (typically glycolic acid or a 2-halo-acetic acid) with at least one member selected from the group consisting of an amine, an alcohol, and an aminoalcohol. The alcohol may have formula $R^1$OH, wherein $R^1$ may be may independently be a hydrocarbyl group, typically containing 4 to 30, or 6 to 20, or 8 to 18 carbon atoms).

In one embodiment the invention provides a method of lubricating an internal combustion engine as disclosed herein, wherein the aluminium alloy may be an eutectic or hypereutectic aluminium alloy (such as those derived from aluminium silicates, aluminium oxides, or other ceramic materials).

In one embodiment the invention provides a method of lubricating an internal combustion engine as disclosed herein, wherein the internal combustion engine has a surface of steel. Typically, the lubricating composition for lubricating a surface of steel may be a lubricating composition comprising an oil of lubricating viscosity and a compound obtained/obtainable by a process comprising reacting a glycolic acid, a 2-halo-acetic acid, or a lactic acid, or an alkali or alkaline metal salts thereof, (typically glycolic acid or a 2-halo-acetic acid) with at least one member selected from the group consisting of an amine, an alcohol, and an aminoalcohol.

In one embodiment the invention provides a method of lubricating an internal combustion engine as disclosed herein, wherein the internal combustion engine has a cylinder bore, cylinder block, or piston ring having an aluminium alloy, aluminium composite or steel (i.e., iron-containing) surface.

In one embodiment the invention provides for the use of the compounds above as an antiwear agent, friction modifier, or lead or copper (typically lead) corrosion inhibitor.

In one embodiment the invention provides for the use of the compounds above as an antiwear agent, a friction modifier (particularly for enhancing fuel economy), or lead or copper (typically lead) corrosion inhibitor in an internal combustion engine lubricant.

Antiwear performance or friction performance may, for instance, be provided by a compound obtained/obtainable by a process comprising reacting a glycolic acid, a 2-halo-acetic acid, or a lactic acid, or an alkali or alkaline metal salts thereof, (typically glycolic acid or a 2-halo-acetic acid) with at least one member selected from the group consisting of an amine, an alcohol, and an aminoalcohol.

Lead or copper corrosion may, for instance, be provided by a compound obtained/obtainable by a process comprising reacting glycolic acid, a 2-halo-acetic acid or alkali or alkaline metal salts thereof, or lactic acid (typically glycolic acid or a 2-halo-acetic acid) with at least one alcohol, wherein the alcohol may be an alkoxy alcohol or a phenoxy alcohol.

DETAILED DESCRIPTION OF THE INVENTION

The present invention provides a lubricating composition and a method for lubricating an engine as disclosed above.

The compound as described herein may also be obtained/obtainable by a process comprising reacting lactic or glycolic acid with a mono-alcohol or mono-amine. Typically compound of this type may be similar to a compound represented by formula (1) (see below).

The monoalcohol may include a variety of alcohols having 4 to 30, or 6 to 20, or 8 to 18 carbon atoms. The alcohols include butanol, 2-methylpentanol, 2-propylheptanol, 2-butyloctanol, 2-ethylhexanol, octanol, nonanol, isooctanol, isononanol, 2-tert-butylheptanol, 3-isopropylheptanol, decanol, undecanol, 5-methylundecanol, dodecanol, 2-methyldodecanol, tridecanol, 5-methyltridecanol, tetradecanol, pentadecanol, hexadecanol, 2-methylhexadecanol, heptadecanol, 5-isopropylheptadecanol, 4-tert-butyloctadecanol, 5-ethyloctadecanol, 3-isopropyloctadecanol, octadecanol, nonadecanol, eicosanol, cetyleicosanol, stearyleicosanol, docosanol and/or eicosyltetratriacontanol. Other useful monoalcohols include oleyl alcohol, stearyl alcohol, coco alcohol, tallow alcohol, or mixtures thereof.

Commercially available alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

The monoamine may include a variety of amines having 4 to 30, or 6 to 20, or 8 to 18 carbon atoms. The monoamine may include butamine, 2-methylpentamine, 2-propylheptamine, 2-butyloctamine, 2-ethylhexamine, octamine, nonamine, isooctamine, isononamine, 2-tert-butylheptamine, 3-isopropylheptamine, decamine, undecamine, 5-methylundecamine, dodecamine, 2-methyldodecamine, tridecamine, 5-methyltridecamine, tetradecamine, pentadecamine, hexadecamine, 2-methylhexadecamine, heptadecamine, 5-isopropylheptadecamine, 4-tert-butyloctadecamine, 5-ethyloctadecamine, 3-isopropyloctadecamine, octadecamine, nonadecamine, eicosamine, cetyleicosamine, stearyleicosamine, docosamine and/or eicosyltetratriacontamine. Other useful monoamines include oleyl amine, stearyl amine, coco amine, tallow amine, or mixtures thereof.

The compound as described herein may also be obtained/obtainable by a process comprising reacting a glycolic acid, a 2-halo-acetic acid, or a lactic acid, or an alkali or alkaline metal salts thereof (typically glycolic acid or a 2-halo-acetic acid) with at least one amine or alcohol, wherein the alcohol may be a diol, a triol or a higher polyol, and wherein the amine may be a diamine, a triamine, or higher polyamine. The alcohol or amine component may also include one or more monoalcohols or monoamines. Typically, a compound of this type may be similar to a compound represented by formula (2) (see below).

The reaction diol, triol or tetrol may include 1,2,7,8-octanetetraol, 2-butyl-1,3-octanediol, 2-butyl-1,3-nonanediol, 1,2,3-heptanetriol, 1,2-butanediol, neopentyl glycol, pentaerythritol, trimethylolpropane, 1,2-hexanediol, 1,2-octanediol, 1,2,decanediol, 1,2-dodecanediol, 1,2-decanediol, 1,2-tetradecanediol, 1,2-hexadecanediol, 1,2-octadecanediol, 1,2-eicosanediol, 2-ethyl-1,3-hexanediol, 2-butyl-2-ethyl-1,3-propanediol, glycerine or ethylene glycol, or mixtures thereof.

The aminoalcohol may include ethanolamine, isopropanolamine, diethanolamine, triethanolamine, diethylethanolamine, dimethylethanolamine, dibutylethanolamine, 3-amino-1,2-propanediol; serinol; 2-amino-2-methyl-1,3-propanediol; tris(hydroxymethyl)-aminomethane; N-methylglucamine, 1-amino-1-deoxy-D-sorbitol; diethanol amine; diisopropanolamine; N-methyl-N,N-diethanol amine; triethanolamine; N,N,N',N'-tetrakis(2-hydroxypropyl)ethylene-diamine, 2-amino-2-methyl-1-propanol, 2-dimethylamino -methyl-1-propanediol, 2-amino-2-ethyl-1,3-propanediol, 2-amino-2-methyl-1,3-propanediol, 2-amino-1-butanol and mixtures thereof.

The alkoxy alcohol or phenoxy alcohol may include oleyl ethoxylate, lauryl ethoxylate, stearyl ethoxylate, coco ethoxylate, tallow ethoxylate, oleyl propoxylate, lauryl propoxylate, stearyl propoxylate, coco propoxylate, tallow propoxylate, phenyl ethoxylate, tert-butyl phenyl ethoxylate, tert-butyl phenyl propoxylate, or mixtures thereof.

Compound of Formula (1) to Formula (3)

In one embodiment the compound as obtained by the process described herein may be represented by a compound of formula (1), or mixtures thereof. In one embodiment the compound obtained by the process described herein may be represented by formula (2), or mixtures thereof. In one embodiment the compound obtained by the process described herein may be represented by formula (3), or mixtures thereof.

The compound is obtained/obtainable by the process described herein may be represented by formula (1) or formula (2) or formula (3):

formula (1)

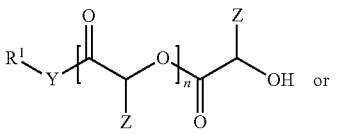

or

-continued formula (2)

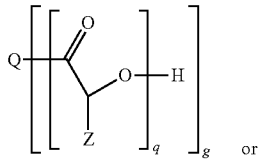

or formula (3)

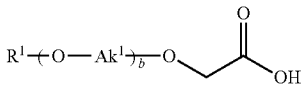

wherein

Y may independently be oxygen or >NH or >NR$^1$;

R$^1$ may independently be a hydrocarbyl group, typically containing 4 to 30, or 6 to 20, or 8 to 18 carbon atoms;

Z may be hydrogen or methyl (when Z=hydrogen, the compound may be derived from glycolic acid, when Z=methyl the compound may be derived from lactic acid, typically Z may be hydrogen);

Q may be the residue of a diol, triol or higher polyol, a diamine, triamine, or higher polyamine, or an aminoalcohol (typically Q may be diol, diamine or aminoalcohol)

g may be 2 to 6, or 2 to 3, or 2;

q may be 1 to 4, or 1 to 3 or 1 to 2;

n may be 0 to 10, 0 to 6, 0 to 5, 1 to 4, or 1 to 3 (when n is above 0, the compound may be described as a dimer (when n=1), trimer (when n=2), or a higher oligomer (when n=3 to 10). In one embodiment n may be 1 to 4, or 1 to 3. In one embodiment n=1 and the compound may be a dimer; and Ak$^1$ may be an alkylene group containing 1 to 5, or 2 to 4 or 2 to 3 (typically ethylene) carbon atoms; and b may be 1 to 10, or 2 to 8, or 4 to 6, or 4.

The compound prepared by the process disclosed herein may be considered to be the same as those derivable from formula (1) or formula (2). In one embodiment the alcohol may be a monoalcohol, or diol, or wherein the amine may be a mono-amine or a polyamine (typically a diamine), or an aminoalcohol. Typically the diol, diamine or aminoalcohol have hydroxy or amino groups attached to carbon atoms in such a way to allow for 1,2- or 1,3-, 1,4-(typically 1,2- or 1,3-) substitution.

In different embodiments the compound of formula (1) or formula (2) may have Z equal to hydrogen, or n may be 0 to 5, 1 to 4, or 1 to 3, or R$^1$ may be an alk(en)yl group, or a cycloalkyl group.

In one embodiment the compound of formula (1) may have Z equal to hydrogen and n may be 1 to 4, or 1 to 3.

In one embodiment the compound of formula (1) to formula (3) may by substantially composed on carbon, oxygen, nitrogen and hydrogen.

In one embodiment the compound of formula (1) to formula (3) may not contain sulphur or phosphorus.

In one embodiment the compound of formula (1) may represented by formula (1a):

Formula (1a)

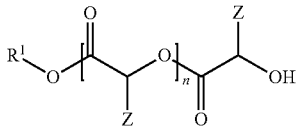

wherein

R$^1$ may be a hydrocarbyl group, typically containing 4 to 30, or 6 to 20, or 8 to 18 carbon atoms;

Z may be hydrogen or methyl (when Z=hydrogen, the compound may be derived from glycolic acid, when Z=methyl the compound may be derived from lactic acid); and n may be 0 to 10, 0 to 6, 0 to 5, 1 to 4, or 1 to 3.

In one embodiment the compound of formula (1) may represented by formula (1b):

Formula (1b)

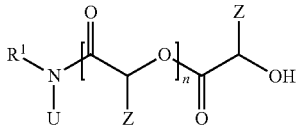

wherein $R^1$ may independently be a hydrocarbyl group, typically containing 4 to 30, or 6 to 20, or 8 to 18 carbon atoms;

Z may be hydrogen or methyl (when Z=hydrogen, the compound may be derived from glycolic acid, when Z=methyl the compound may be derived from lactic acid);

U may be hydrogen or $R^1$; and n may be 0 to 10, 0 to 6, 0 to 5, 1 to 4, or 1 to 3.

In formula (1b) when Z=hydrogen, n=1, U=hydrogen the resultant compound may be represented by formula (1b)(i):

formula (1b)(i)

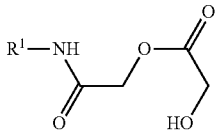

wherein $R^1$ may independently be a hydrocarbyl group, typically containing 4 to 30, or 6 to 20, or 8 to 18 carbon atoms.

Examples of a compound of this type include oleyl glycolamide-glycolate, stearyl glycolamide-glycolate, coco glycolamide-glycolate, tallow oleyl glycolamide-glycolate, or mixtures thereof.

In one embodiment the compound of formula (2) may be represented by formula (2a):

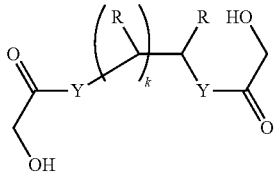

wherein each R may independently be hydrogen, or a hydrocarbyl group, typically containing 4 to 30, or 6 to 20, or 8 to 18, or 8 to 16 carbon atoms;

k may be 1 to 4, or 1 to 3, 1 to 2, or 1; and

Y may independently be oxygen or >NH or >$NR^1$.

In one embodiment Y may be oxygen, a compound of formula (2a) (typically obtained by the reaction of a diol with glycolic acid) and the compound may be represented by formula (2b):

formula (2b)

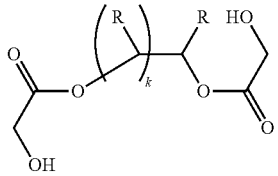

wherein k may be 1 to 4, or 1 to 2, or 1; and each R may independently be hydrogen, or a hydrocarbyl group, typically containing 4 to 30, or 6 to 20, or 8 to 18, or 8 to 16 carbon atoms.

For compounds of formula (2a), these may be prepared from a diol such as a diglycolic acid ester including 1,2-dodecanediol diglycolate, 2-decanediol diglycolate, 2-tetradecanediol diglycolate, or mixtures thereof.

In one embodiment Y may be >NH or >$NR^1$, a compound of formula (2a) (typically obtained by the reaction of a diamine with glycolic acid) may be represented by formula (2c):

formula (2c)

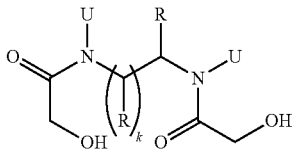

wherein

U may be hydrogen or $R^1$, $R^1$ may be a hydrocarbyl group, typically containing 4 to 30, or 6 to 20, or 8 to 18 carbon atoms;

each R may independently be hydrogen, or a hydrocarbyl group, typically containing 4 to 30, or 6 to 20, or 8 to 18, or 8 to 16 carbon atoms; and k may be 1 to 4, or 1 to 3.

For compounds of formula (2a), these may be prepared from a diamine such as a "Duomeen™" series amine (available from Akzo Nobel), or mixtures thereof. The Duomeen may be Duomeen T or Duomeen O. The diamine may be prepared by the addition a monoamine to acrylonitrile, followed by catalytic reduction of the resulting nitrile compound, using, e.g., $H_2$ over Pd/C catalyst, to give the diamine.

A compound of formula (3) may be obtained from an alkoxy alcohol or phenoxy alcohol reacted with a 2-halo-acetic acid (or alkali or alkaline metal salts thereof). The 2-halo-acetic acid may be chloro- or bromo- or iodo-acetic acid, or mixtures thereof. The chloro- or bromo- or iodo-acetic acid may also be in the form of sodium, lithium or potassium salts thereof. In one embodiment the compound of formula (3) may be derived from sodium 2-chloroacetate or 2-chloroacetic acid reacted with an alkoxy alcohol or phenoxy alcohol. Compounds of the type described by formula (3) and their preparation are disclosed in WO 2009/040370, EP 1 354 905, and EP 1 061 064 (all assigned to Clariant G.m.b.H). The compound derived from the alkoxy alcohol may include a compound represented by formula (3a):

formula (3a)

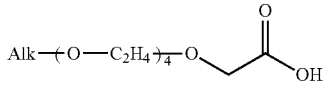

wherein the alk group may be $C_{8-18}$ or $C_{10-18}$ alkyl or alkylene (alk may for example include lauryl, oleyl, stearyl, tallow, coco, or mixtures thereof).

The compound derived from the alkoxy alcohol may include a compound represented by formula (3b):

formula (3b)

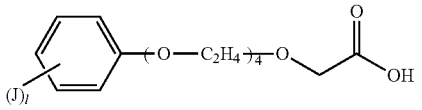

wherein J may be a linear or branched alkyl group (typically having 4 to 20, or 4 to 12, or 4 to 8 carbon atoms such as tert-butyl, or 2-ethylhexyl); and l may be 0 to 5, or 0 to 2, or 0 to 1.

The reaction to prepare the compound of the present invention may be performed in a variety of different reaction conditions. The reaction may be carried out at a reaction temperature in the range of 70° C. to 200° C., or 90° C. to 180° C., or 100° C. to 160° C. The reaction may be carried out in an inert atmosphere, e.g., under nitrogen or argon, typically nitrogen. The reaction may be performed in the presence or absence of a solvent (typically including a solvent). The solvent includes an aromatic hydrocarbon solvent. The reaction may be carried out in the absence or presence of catalyst (typically in the presence of a catalyst). The catalyst may include methane sulphonic acid, toluene sulphonic acid, benzene sulphonic acid, or $C_{12}H_{25}$-alkylbenzenesulphonic acid. The catalyst may also include metal salts of titanium, zirconium or aluminium that have counterions of chloride, bromide, iodide, or alkoxides (wherein alkyl group on the alkoxide may have 1 to 20, or 1 to 4 carbon atoms), or mixtures thereof. The catalyst may also include of a phosphate of formula HO—$(P(O)(OH)O)_c$—H, where e may be 1 to 5, or 2 to 5. In one embodiment the catalyst may be a sulphonic acid, typically methane sulphonic acid.

Examples of an aromatic hydrocarbon solvent include aromatic hydrocarbon solvent include Shellsolv AB® (commercially available from Shell Chemical Company); and toluene extract, xylene Aromatic 200, Aromatic 150, Aromatic 100, Solvesso 200, Solvesso 150, Solvesso 100, HAN 857® (all commercially available from Exxon Chemical Company), or mixtures thereof. Other aromatic hydrocarbon solvents include xylene, toluene, or mixtures thereof.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group I, or Group II, or Group III, or Group IV oil. In one embodiment the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives include at least one of metal deactivators, viscosity modifiers, detergents, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of a dispersant, an antiwear agent, a dispersant viscosity modifier, a friction modifier, a viscosity modifier, an antioxidant, an overbased detergent, or mixtures thereof.

The dispersant of the present invention may be a succinimide dispersant, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be a N-substituted long chain alkenyl succinimide. Examples of N-substituted long chain alkenyl succinimide include polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt % of the lubricating composition.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 15 wt %, or 0.1 wt % to 10 wt %, or 0.5 wt % to 5 wt % of the lubricating composition and may be used in an amount consistent with providing the desired low phosphorus level described elsewhere herein.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulphur containing phenates, sulphur containing phenates, sulphonates, salixarates, salicylates, and mixtures thereof. Typically an overbased detergent may be a sodium, calcium or magnesium salt of the phenates, sulphur containing phenates, sulphonates, salixarates and salicylates. Overbased phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). The predominantly linear alkylbenzene sulphonate detergent may be particularly useful for assisting in improving fuel economy. Overbased detergents are known in the art. The overbased detergent may be present at 0 wt % to 15 wt %, or 0.1 wt % to 10 wt %, or 0.2 wt % to 8 wt % of the lubricating composition.

In one embodiment the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulphurised olefins, alkylated diphenylamines (typically dinonyl diphenylamine, octyl diphenylamine, dioctyl diphenylamine), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butyl-phenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of suitable friction modifiers include long chain fatty acid derivatives of amines, esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, esters, or epoxides; fatty alkyl tartrates; fatty alkyl tartrimides; and fatty alkyl tartramides. The fatty alkyl tartrates; fatty alkyl tartrimides; and fatty alkyl tartramides.

In one embodiment the friction modifier may be a long chain fatty acid ester. In another embodiment the long chain fatty acid ester may be a mono-ester and in another embodiment the long chain fatty acid ester may be a (tri)glycerides.

Other performance additives such as corrosion inhibitors include those described in paragraphs 5 to 8 of US Application US05/038319, published as WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexyl acrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Compound Disclosed Herein | 0.01 to 5 | 0.1 to 3 | 0.2 to 1.5 |
| Dispersant | 0.05 to 12 | 0.75 to 8 | 0.5 to 6 |
| Dispersant Viscosity Modifier | 0 to 5 | 0 to 4 | 0.05 to 2 |
| Overbased Detergent | 0 to 15 | 0.1 to 10 | 0.2 to 8 |
| Antioxidant | 0 to 15 | 0.1 to 10 | 0.5 to 5 |
| Antiwear Agent | 0 to 15 | 0.1 to 10 | 0.3 to 5 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Industrial Application

The lubricating composition may be utilised in an internal combustion engine. The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulphated ash content may be 0.05 wt % to 0.9 wt %, or 0.1 wt % to 0.2 wt % or to 0.45 wt %.

In one embodiment the lubricating composition may be an engine oil, wherein the lubricating composition may be characterised as having at least one of (i) a sulphur content of 0.5 wt % or less, (ii) a phosphorus content of 0.1 wt % or less, and (iii) a sulphated ash content of 1.5 wt % or less.

The following examples provide illustrations of the invention. These examples are non-exhaustive and are not intended to limit the scope of the invention.

EXAMPLES

Preparative Example 1

(EX1) is 1,2-dodecanediol diglycolate. A 1 litre flange flask is fitted with PTFE gasket, flange lid, nitrogen inlet providing a nitrogen flow of 200 $cm^3$/min, thermocouple, overhead stirrer with PTFE gland and Dean-Stark trap fitted with double wall water cooled condenser. The flask is charged with glycolic acid (105.77 g), toluene (250 g), 1,2-dodecanediol (190.9 g) and methanesulfonic acid (6.45 g). The reaction is warmed to 105° C., stirring is initiated at 50° C. at 200 rpm and increased to 350 rpm as the reaction becomes homogeneous. As the temperature approaches 105° C. a milky solution begins to collect and separate in Dean-Stark trap. The first 100 ml fluid is collected and discarded. The temperature is increased to 135° C. and reflux is sustained for 18 hours. The flask is equipped for vacuum stripping and vacuum is gradually increased to 50 mm Hg (equivalent to 6 kPa) and held for 1 hour. The flask contents are cooled to 70° C. and vacuum is released. The viscous coloured oil is transferred whilst hot to produce 248.97 g of product.

Preparative Example 2

(EX2) is oleyl glycolate. A 2 litre round bottom flange flask equipped with mechanical stirrer, thermocouple, sub-surface nitrogen sparge line and Dean-Stark trap with condenser is set up. 69.98 g of glycolic acid, 246.58 g of oleyl alcohol and 750 $cm^3$ of xylene are charged to the flask. Then 6.28 g of methane sulphonic acid is added and the reaction is heated to 145° C. on a mantle, with stirring. The xylene is allowed to reflux for 3 hours. The heat is then removed and allowed to cool overnight with a nitrogen purge. Solvent is then stripped on a rotary evaporator. The product is then heated in an oven at 100° C., causing the solid to melt. The reaction produces 300 g of product.

Preparative Example 3

(EX3) is oleyl glycolamide-glycolate. A 250 $cm^3$ round bottom flask is charged with 20 g of toluene, 50 g of oleyl amine, and 28.43 g of glycolic acid. The flask is then heated to 100° C. under a nitrogen atmosphere (flow rate of 200 $cm^3$/min). The flask is then held at 100° C. and stirred for 18 hours with a stirring speed of at 250 rpm. The flask is then heated to 110° C. and stirred for 2 hours. The flask is then heated to 130° C. and stirred for 4 hours. The flask is then heated to 150° C. and stirred for 4 hours before cooling to ambient. The reaction yields 69.4 g.

Preparative Example 4

(EX4) is oleyl alcohol-glycolic acid ester (1:2.5 mole ratio). A one-litre, 4-neck flask equipped with an overhead stirrer, thermowell, subsurface inlet with nitrogen line, and Dean-Stark trap with condenser is charged with 250 g of oleyl alcohol, 176.8 g of glycolic acid, 150 g of toluene. The flask is then heated to 120° C. under a nitrogen atmosphere (flow rate of 200 $cm^3$/min) and stirred at 250 rpm. 6.4 g of methane sulphonic acid is then added and the flask is heated to 135° C. and stirred for 26 hours. The flask is then heated to 150° C. and held for 2 hours. The flask is then vacuum distilled at a pressure of 6 kPa (equivalent to 50 mm Hg) over two hours. The flask is then cooled to ambient and 258.3 g of dark coloured waxy-solid product is obtained.

Preparative Example 5

(EX5) is oleyl polyglycolate (1:4 mole ratio). EX5 is similar to EX4, except the amount of glycolic acid is 4 moles of glycolic acid per mole of oleyl alcohol in place of 2.5 moles.

Preparative Example 6

(EX6) is stearyl glycolate is prepared in a similar manner as EX2, except on a mole basis the amount of oleyl alcohol is replaced with stearyl alcohol.

Preparative Example 7

(EX7) is 2-ethylhexyl glycolate. A one-litre, 4-neck flask equipped with an overhead stirrer, thermowell, subsurface inlet with nitrogen line, and Dean-Stark trap with condenser is charged with 200 g of 2-ethylhexanol, 11.2 g of glycolic acid, 300 g of toluene. The flask is then heated to 130° C. under a nitrogen atmosphere (flow rate of 200 $cm^3$/min) and stirred at 250 rpm for 3 hours. 10.1 g of methane sulphonic acid is then added and the flask is heated to 135° C. and stirred for 16 hours. The flask is then cooled to ambient before addition of 200 $cm^3$ of sodium bicarbonate solution. Product is then extracted with 1.6 L of methylene chloride to 150° C. and held for 2 hours before washing with saturated sodium bicarbonate solution (100 $cm^3$), water (2×200 $cm^3$) and dried over magnesium sulphonate. The resultant product is a colourless oil (250.6 g).

Preparative Example 7

(EX7) is 2-ethylhexylglycolamide. A one-litre, 4-neck flask equipped with an overhead stirrer, thermowell, subsurface inlet with nitrogen line, and Dean-Stark trap with condenser is charged with 200 g of 2-ethylhexylamine, 114.7 g of glycolic acid, 200 g of xylene. The flask is then heated to 150° C. under a nitrogen atmosphere (flow rate of 200 $cm^3$/min) and stirred at 250 rpm for 3 hours. The flask is then vacuum distilled at a pressure of 6 kPa (equivalent to 50 mm Hg) over three hours. The flask is then cooled to ambient and 214.3 g of dark coloured waxy-solid product is obtained.

Example 8

(EX8) is glycolic acid ethoxylate oleyl ether obtained from Aldrich (CAS Number 57635-48-0).

Example 9

(EX9) is glycolic acid ethoxylate lauryl ether obtained from Aldrich (CAS Number 220622-96-8).

Example 10

(EX10) is glycolic acid ethoxylate tert-butylphenyl ether obtained from Aldrich (CAS Number 104909-82-2).

SAE 15W-30 Engine Lubricants

A series of SAE 15W-30 engine lubricants are prepared containing antioxidants (mixture hindered phenols and alkylated diphenylamines), 0.5 wt % of zinc dialkyldithiophosphate, a mixture of detergents (including calcium sulphonate and calcium phenate), a succinimide dispersant, and further containing 0.25 wt %, or 0.50 wt %, or 1.0 wt % of a product from EX1 to EX10.

Comparative Example 1

(CE1) is a SAE 5W-30 lubricant the same as those described above, except it does not contain a product of example EX1 to EX6.

Comparative Example 2

(CE2) is a SAE 5W-30 lubricant the same CE1, except it contains 0.5 wt % of fatty tartrate. CE2 is similar to example 21 of WO2005087904, except the dibutyl tartrate has been replaced with fatty tartrate.

Test 1: Friction Performance in HFRR

The SAE 5W-30 lubricants are evaluated for boundary lubrication friction performance and wear in a programmed temperature high frequency reciprocating rig (HFRR) available from PCS Instruments. HFRR conditions for the evaluations are 500g load, 75 minute duration, 1000 micrometer stroke, 20 Hertz frequency, and temperature profile of 15 minutes at 40° C. followed by an increase in temperature to 160° C. at a rate of 2° C. per minute. The upper test piece is a 6 mm diameter steel ball (ANSI E-52100, Rockwell 'C' hardness 58-66 and a surface finish of Ra<0.05 μm), the lower test specimen is either a flat steel disc (ANSI E-52100, Vickers "HV30" hardness 190-210 and a surface finish of Ra<0.02 μm) or an aluminium specimen of similar size. Both the upper and lower specimens are available together from PCS Instruments (Part Number HFRSSP). The coefficient of friction, wear and contact potential are then measured. The coefficient of friction is calculated by dividing the measured friction force parallel to the direction of reciprocation by the load applied. The contact potential is measured by applying a small electrical potential between the upper and lower test specimens. If the instrument measures the full electrical potential applied, this is indicative of an electrically insulating layer between the upper and lower test specimens, this is usually interpreted as the formation of a chemical protective film on the surfaces. If no protective film is formed there is metal to metal contact between the upper and lower test specimens and the measured electrical potential drops to zero. Intermediate values are indicative of partial or incomplete protective films. The contact potential is often presented as a percentage of the applied electrical potential and called percent film thickness. The wear, coefficient of friction and contact potential results obtained are presented in the following table.

| 5W-30 Lubricant Example | Product of Example | Fe Wear Scar (μm) | Al Wear Scar (μm) | CoF | Contact Potential |
|---|---|---|---|---|---|
| CE1 | 0 | 252 | 298 | 0.124 | 97 |
| L1 | EX1 | 205 | 219 | 0.117 | 96 |
| L2 | EX2 | 271 | 322 | 0.121 | 92 |
| L3 | EX3 | 218 | 232 | 0.107 | 96 |
| L4 | EX4 | 221 | 233 | 0.128 | 97 |
| L5 | EX5 | 199 | 249 | 0.112 | 94 |
| L6 | EX6 | 231 | 275 | 0.121 | 96 |
| L7 | EX1 | 196 | 198 | 0.121 | 96 |
| L8 | EX2 | 219 | 242 | 0.120 | 97 |
| L9 | EX3 | 171 | 195 | 0.084 | 97 |
| L10 | EX4 | 209 | 240 | 0.118 | 96 |
| L11 | EX5 | 179 | 223 | 0.117 | 97 |
| L12 | EX6 | 258 | 277 | 0.107 | 96 |
| L13 | EX1 | 213 | 169 | 0.123 | 96 |

-continued

| 5W-30 Lubricant Example | Product of Example | Fe Wear Scar (μm) | Al Wear Scar (μm) | CoF | Contact Potential |
|---|---|---|---|---|---|
| L14 | EX2 | 215 | 233 | 0.109 | 97 |
| L15 | EX3 | 181 | 160 | 0.085 | 97 |
| L16 | EX4 | 220 | 230 | 0.109 | 95 |
| L17 | EX5 | N/M | N/M | N/M | N/M |
| L18 | EX6 | 212 | 235 | 0.117 | 97 |

Footnote:
Lubricant Examples 1 to 6 contain 0.25 wt % of a compound prepared in EX1 to EX6 respectively.
Lubricant Examples 7 to 12 contain 0.5 wt % of a compound prepared in EX1 to EX6 respectively.
Lubricant Examples 13 to 18 contain 1.0 wt % of a compound prepared in EX1 to EX6 respectively.

The wear scar results shown above for Fe (iron) and Al (aluminium) surfaces are the average of two experiments per sample.

The coefficient of friction (CoF) and contact potential are an average over two experiments per sample.

N/M indicates data points not measured.

Test 2: Lead Corrosion Test

The lubricants described above (LE1 to LE10 and CL1) are evaluated in lead corrosion test as defined in ASTM Method D6594-06. The amount of lead (Pb) in the oils at the end of test is measured and compared to the amount at the beginning of the test. Lower lead content in the oil indicates decreased lead corrosion. Overall the results obtained for each lubricant are as follows:

| Lubricant Example | Lead (ppm) |
|---|---|
| CE2 | 86 |
| EX2 | 72 |
| EX5 | 40 |
| EX6 | 66 |

SAE 15W-30 Engine Lubricants

A series of three SAE 15W-30 engine lubricants (L19 to L21) are prepared containing antioxidants (mixture hindered phenols and alkylated diphenylamines), zinc dialkyldithiophosphate, a mixture of detergents (including calcium sulphonate and calcium phenate), a succinimide dispersant, and further containing 0.1 wt % of EX8 to EX10 respectively. The compositions are characterised as having about 0.11 wt % phosphorus, 0.12 wt % zinc and 0.22 wt % of calcium.

Comparative Example 3

(CE3) is prepared in a similar formulation as L19, except it does not contain a glycolate as described in EX8 to EX10.

L19 to L21 and CE3 are evaluated in lead corrosion test as defined in ASTM Method D6594-06 (see above for more information). The data obtained is as follows:

| Lubricant Example | Lead (ppm) |
|---|---|
| CE3 | 66 |
| L19 | 50 |
| L20 | 58 |
| L21 | 48 |

Overall the data presented indicates that the lubricating composition of the invention (for example, an internal combustion engine lubricant) containing a compound of the invention provides one or more of antiwear performance, friction modifier (particularly for enhancing fuel economy) performance, or lead corrosion inhibition.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

As used here the term "alk(en)yl" includes alkyl and alkenyl.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and 0.01 to 5 wt % of a compound obtained by a process comprising reacting a glycolic acid or an alkali or alkaline metal salt thereof, with at least one member selected from the group consisting of an amine, an alcohol, and an aminoalcohol, wherein the compound is represented by formula (3)

formula (3)

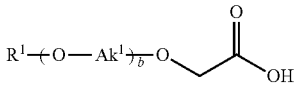

wherein $R^1$ is independently a hydrocarbyl group, containing 4 to 30 carbon atoms;

$Ak^1$ is an alkylene group containing 1 to 5 carbon atoms; and b is 1 to 10.

2. The lubricating composition of claim 1, wherein the compound is derived from above substantially composed of carbon, oxygen, nitrogen and hydrogen only.

3. The lubricating composition of claim 1, wherein the compound of formula (3) does not contain sulphur or phosphorus.

4. The lubricating composition of claim 1, wherein the compound of formula (3) is represented by formula (3a):

Formula (3a)

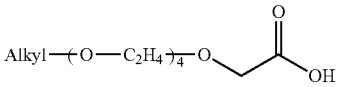

wherein the alkyl group is $C_{8-18}$.

5. The lubricating composition of claim 1, wherein the compound of formula (3) is represented by formula (3b):

Formula (3b)

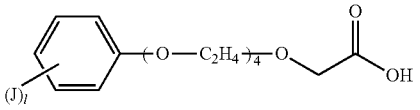

wherein

J is a linear or branched alkyl group; and the alkyl group is $C_{8-18}$;

l is 0 to 5.

6. The lubricating composition of claim 5, wherein l is 1, the alkyl group is $C_{10-18}$; and J is a branched alkyl group.

7. The lubricating composition of claim 1, wherein the compound is present at 0.2 wt % to 1.5 wt % of the lubricating composition.

8. The lubricating composition of claim 1, wherein the compound obtained by the process is present at 0.25 wt % to 1 wt % of the lubricating composition.

9. The lubricating composition of claim 1, wherein the lubricating composition is characterised as having (i) a sulphur content of 0.5 wt % or less, (ii) a phosphorus content of 0.1 wt % or less, and (iii) a sulphated ash content of 1.5 wt % or less.

10. The lubricating composition of claim 1 further comprising at least one of an antiwear agent, a dispersant viscosity modifier, a friction modifier, a viscosity modifier, an antioxidant, an overbased detergent, or mixtures thereof.

11. The lubricating composition of claim 1 further comprising zinc dialkyldithiophosphate.

12. The lubricating composition of claim 1 further comprising an overbased detergent, wherein the overbased detergent is selected from the group consisting of phenates, sulphur containing phenates, sulphonates, salixarates, salicylates, and mixtures thereof.

13. A method of lubricating an internal combustion engine comprising supplying to the internal combustion engine a lubricating composition of claim 1.

14. The method of claim 13, wherein the internal combustion engine is lubricated with a lubricating composition of claim 1, and wherein the engine has a cylinder bore, cylinder block, or piston ring having an aluminium alloy, aluminium composite or steel surface.

15. The method of claim 13, wherein the internal combustion engine is lubricated with a lubricating composition of claim 1, and wherein the engine has a cylinder bore, cylinder block, or piston ring having a steel surface.

16. The method of claim 13, wherein the internal combustion engine is lubricated with a lubricating composition of claim 1, and wherein the engine has a cylinder bore, cylinder block, or piston ring having an aluminium alloy or aluminium composite surface.

* * * * *